US005864898A

United States Patent [19]

Knapp et al.

[11] Patent Number: 5,864,898

[45] Date of Patent: Feb. 2, 1999

[54] APRON ASSEMBLY FOR A BATHING FIXTURE

[75] Inventors: Scott R. Knapp, Sheboygan; Peter W. Swart, Oostburg, both of Wis.

[73] Assignee: Kohler Co., Kohler, Wis.

[21] Appl. No.: 700,715

[22] Filed: Aug. 13, 1996

[51] Int. Cl.[6] ..... A47K 3/02

[52] U.S. Cl. ..... 4/584

[58] Field of Search ..... 4/538, 584

[56] References Cited

U.S. PATENT DOCUMENTS

| | | | |
|---|---|---|---|
| 1,009,483 | 11/1911 | Danver | 4/584 |
| 2,269,748 | 1/1942 | Widman | 4/584 |
| 2,695,256 | 11/1954 | DeOlloqui et al. | 4/538 X |
| 2,784,417 | 3/1957 | Strand | 4/595 |
| 2,967,309 | 1/1961 | Corp | 4/538 |
| 3,028,603 | 4/1962 | Rodman | 4/559 |
| 3,412,727 | 11/1968 | Hurko | 4/633 X |
| 4,290,154 | 9/1981 | Benjamin | 4/538 |
| 4,541,130 | 9/1985 | Calvert et al. | 4/593 |
| 4,669,133 | 6/1987 | Blecher et al. | 4/538 |

FOREIGN PATENT DOCUMENTS

| | | | |
|---|---|---|---|
| 85 18 953.7 | 8/1985 | Germany . | |
| 3839614 | 5/1990 | Germany | 4/584 |
| 94 04 056.4 | 5/1994 | Germany . | |
| 0507425 | 6/1939 | United Kingdom | 4/584 |
| 0844323 | 8/1960 | United Kingdom | 4/584 |
| 1028079 | 5/1966 | United Kingdom | 4/584 |

*Primary Examiner*—Robert M. Fetsuga
*Attorney, Agent, or Firm*—Quarles & Brady

[57] ABSTRACT

An apron assembly for a bathing fixture which allows access to equipment placed behind it without requiring any additional hardware and cost to the bathtub and affords precise alignment of the apron assembly with the rim of the bathing fixture. In a preferred manner, a bolt is threaded to a metal brace member on a frame which has access openings adjacent the bolt for adjustment purposes. The bolt acts as an adjustable brace. A panel member is easily attached to and removed from the frame member.

7 Claims, 1 Drawing Sheet

APRON ASSEMBLY FOR A BATHING FIXTURE

BACKGROUND OF THE INVENTION

A. Field of the Invention

This invention relates to structures for enclosing bathing fixtures such as bathtubs and whirlpools. More particularly, it relates to aprons for attachment thereto.

B. Description of the Art

Aprons for bathtubs and whirlpools are commonly used to give a finished look to a bathtub and whirlpool, and in the instance of the latter, to provide access to equipment such as pumps, motors, piping, etc. located behind the apron. A problem arises with installing aprons which are made of flexible materials and securing them to the bathing fixture. There is also a need to provide access to various equipment such as pumps, motors and piping associated with bathing fixtures.

In U.S. Pat. No. 4,669,133 there is described an apron for bathtubs which has an adjustment feature for sheet-form materials. However, it requires the use of a suction cup, does not afford alignment with a tub rim and has no opening to provide access to any equipment located behind it.

Another problem with aprons of the type which afford adjustable alignment is access to an adjustment device located behind the apron. With the apron covering the side wall of the bathing fixture, this presents a problem.

Most apron designs require attachment hardware underneath and affixed to the tub. This adds to the cost.

Another factor is that to reduce costs, plastic materials of minimal thickness are used, yet it is desirable to have an apron structure which is rigid and easily aligned with the bathing fixture.

Thus, it can be seen that a need exists for an improved apron assembly.

SUMMARY OF THE INVENTION

In one aspect, the invention provides an apron assembly for a bathing fixture which includes a bathing tub having an outwardly extending rim. A frame member having at least one open section is constructed and arranged to be positioned in front of a side wall of the tub, the frame member contacting the rim adjacent an upper portion of the frame member. An adjustment bolt is threadably connected to the frame member adjacent an upper end portion for engagement with the side wall of the tub so as to laterally move the frame into contact with the rim. A panel member is adapted to be inserted into the frame member to cover the open section.

In a preferred embodiment, the apron assembly includes a brace member attached to the frame member adjacent the upper end portion thereof, the adjustment bolt being threadably engaged in the brace member.

In another aspect, the brace is of a tubular construction and composed of steel, and the frame member is composed of a plastic material.

In another embodiment, the adjustment bolt is located adjacent the open section of the frame member to provide access thereto through the open section when it is not covered by the panel member.

In another aspect, the panel member has a lip portion for engagement with an inner portion of the rim.

The objects of the invention therefore include:

a. providing an apron assembly of the above kind which can be easily installed;

b. providing an apron assembly of the above kind which can provide ready access to equipment placed behind the apron assembly;

c. providing an apron assembly of the above kind which can be manufactured from readily available materials and with a reduced amount of material, yet afford a stable construction; and d. providing an apron assembly of the above kind which can be fitted to bathing fixtures having rims of various dimensions and independent of bathtubs having no additional attachment hardware.

These and still other objects and advantages of the invention will be apparent from the description which follows. In the detailed description below, a preferred embodiment of the invention will be described in reference to the accompanying drawings. The embodiment does not represent the full scope of the invention. Rather the invention may be employed in other embodiments. Reference should therefore be made to the claims herein for interpreting the breadth of the invention.

DESCRIPTION OF THE PREFERRED EMBODIMENT

Figure 1:
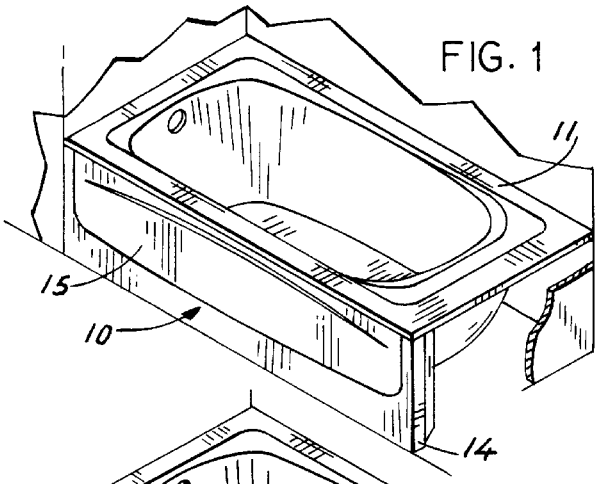
FIG. 1 is a top perspective view (partially fragmented) illustrating the apron assembly of this invention attached to a bathing fixture.
Figure 2:
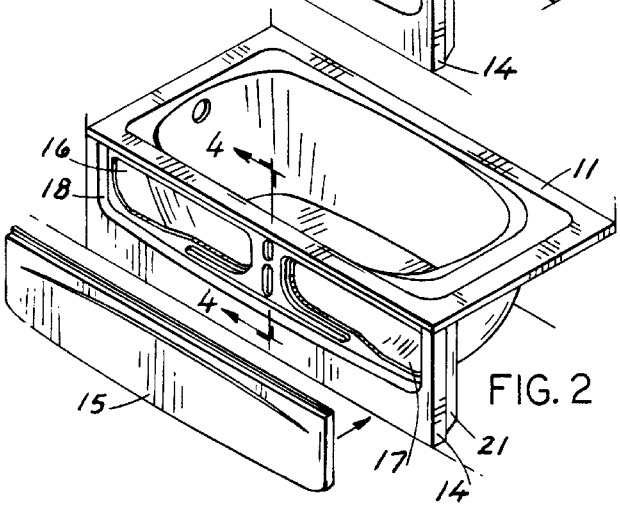
FIG. 2 is a view similar to FIG. 1 albeit with an apron panel removed.
Figure 3:
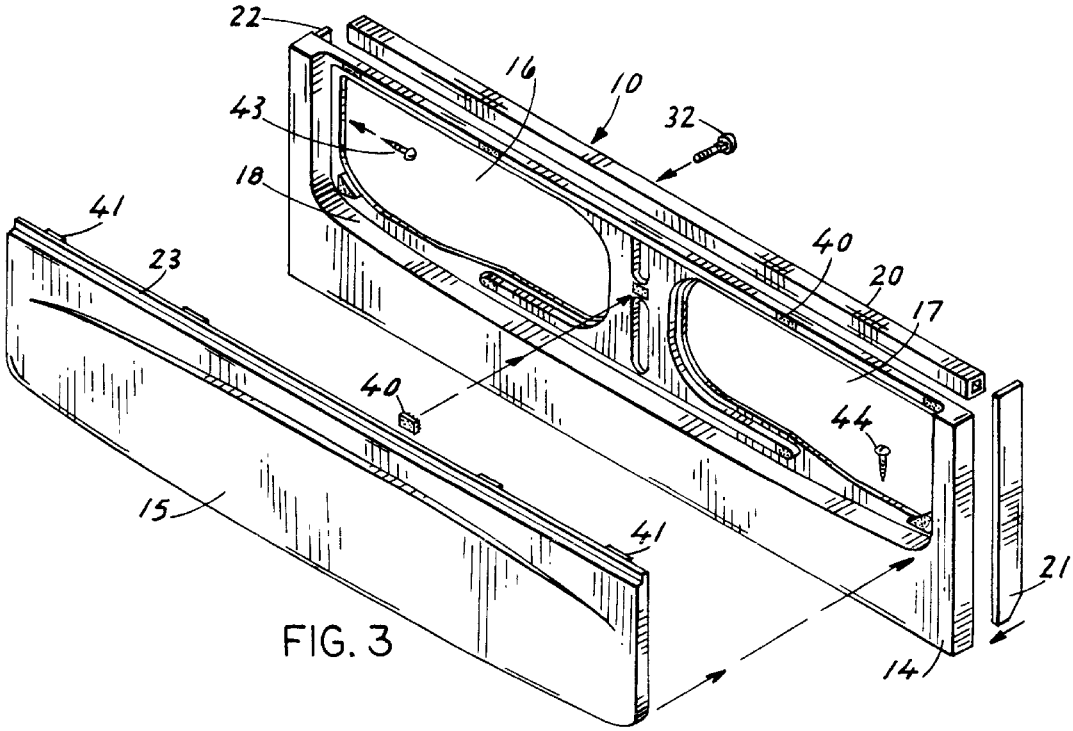
FIG. 3 is an enlarged exploded view of the apron assembly.

Referring to FIGS. 1–3, the apron assembly, generally 10, is shown attached to a bathing fixture 11. The apron assembly includes a frame member 14 with open sections 16 and 17 positioned in a recessed section 18. A panel member 15 is dimensioned to fit into the recessed section 18 and over the open sections 16 and 17. The frame member 14 and panel member 15 are preferably composed of a plastic material.

Referring specifically to FIG. 3, there is a tubular brace member or adjustment bolt receiving member 20 preferably composed of steel that is attached at the top by means of gluing to the frame member 14 (or other means). There are also side braces 21 and 22 which are connected to the frame such as by stapling.

Figure 4:
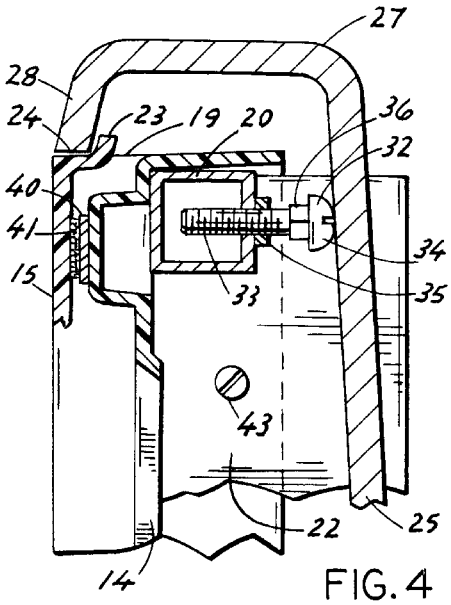
FIG. 4 is a view in section taken along line 4—4 of FIG. 2 (albeit with the center panel assembled therewith).

As seen in FIGS. 3 and 4, a bolt 32 with threads 33 is threadably engaged in the tubular brace member 20. To secure the apron assembly to the bathing fixture 11, the frame member 14 has the top portion 19 positioned under the rim 27 of the bathing fixture 11. The frame member is pushed up until the top portion 19 engages the lower surface. 24 of rim 27. At this stage, a carriage bolt such as 32 is selected which can best be adjusted to span the distance from the center of the frame member 14 to the backside of the bath as represented by the side wall 25.

The bolt is threaded into a threaded opening in the brace as far as it can go. The frame member 14 is then squared to the rim 27, and the side braces 21 and 22 of the frame are secured to studs such as with the screws 43 passing through the side braces 21 and 22. The bottom of the frame member is secured to a subfloor with screws such as shown at 44. If necessary, some shimming can be effected for the frame member 14 at the bottom thereof.

The next step is the unthreading or outthreading of the carriage bolt 32 until the head 34 makes contact with the side wall 25. Note that immediately in front of the bolt head 32 is a hex surface 36 for contact with a wrench to turn the bolt 32. Then the bolt is locked in position by tightening the nut 35. The apron panel member 15 is then centered on the frame member 14 and pressed onto it. The lip 23 of the panel member 15 is sandwiched behind rim 27. The panel member 15 will be engaged by the hook and loop fasteners 40 and 41 which are preferably adhesively secured to the respective and frame member 14 and panel member 15.

When it is necessary to remove the panel member 15 from the frame member 14, such as to have access to the usual equipment and plumbing placed behind the apron, all that is necessary is to place, for example, the head of a screwdriver between the panel member 15 and the frame member 14 at the bottom of the panel and pry it from this position.

An important feature of the apron assembly of this invention is the lateral adjustment provided by the bolt 32. This affords precise alignment of the frame and panel members 14 and 15 with the outer surface 28 of the rim 27.

Another feature is the placement of the bolt 32 on the tubular brace member 20 adjacent the open sections 16 and 17. This allows for access to the adjustment bolt 32 during the alignment process, as well as access to equipment normally housed behind the apron.

Still another feature of the invention is the positioning of the lip 23 behind the rim 27. This provides a stable placement.

Yet another feature is the use of the brace member 20 in the form of a metal tube. This not only affords a stiffening of the frame member 14, yet allows for stable threadable engagement by the bolt 32.

Yet another feature is the ease of placement and removal of the panel member 15 by means of the hook and loop fasteners 40.

Thus, the invention provides an improved apron assembly. While a preferred embodiment has been described above, it should be readily apparent to those skilled in the art that a number of modifications and changes may be made without departing from the spirit and scope of the invention. For example, while a frame with two open sections 16 and 17 have been shown, a single open section could be employed although it would not afford as much access and stability. Additionally, hook and loop fasteners 40 are illustrated for holding the panel 15 and frame 14 members together. Screws could be substituted but would not be as efficient or aesthetically appearing. Also, the specific materials mentioned are not the only materials which can be used. Moreover, if desired more than one bolt 32 can be used in conjunction with brace member 20. All such and other modifications within the scope of the invention are meant to be in the scope of the invention.

What is claimed is:

1. A bathing fixture having an apron comprising:

a tub having an externally extending rim;

a frame member having at least one open section constructed and arranged to be positioned in front of a side wall of the tub, the frame member contacting the rim adjacent an upper portion of the frame member;

an adjustment bolt threadably and extendably connected to the frame member adjacent an upper end portion thereof for engagement with the side wall of the tub so as to laterally move the frame into contact with the rim;

a panel member adapted to be inserted onto the frame member to cover the open section; and a brace member attached to the frame member adjacent the upper end portion thereof, the adjustment bolt being threadably engaged in the brace member.

2. The apron assembly for a bathing fixture as defined in claim 1, wherein the brace member is of a tubular construction.

3. The apron assembly for a bathing fixture as defined in claim 1, wherein the brace member is composed of steel and the frame member is composed of a plastic material.

4. The apron assembly for a bathing fixture as defined in claim 1, wherein the adjustment bolt is located adjacent the open section of the frame member to provide access thereto through the open section when it is not covered by the panel member.

5. The apron assembly for a bathing fixture as defined in claim 1, wherein the panel member has a lip portion for engagement with an inner portion of the rim.

6. The apron assembly for a bathing fixture as defined in claim 1, wherein the panel member is attached to the frame member by hook and loop type fasteners.

7. A bathing fixture having an apron, comprising:

a tub having an outwardly extending rim;

a frame member having at least one open section constructed and arranged to be positioned in front of a side wall of the tub, the frame member contacting the rim adjacent an upper portion of the frame member;

an adjustment bolt threadably and extendably connected to the frame member adjacent an upper end portion thereof for engagement with the side wall of the tub at an outer end of the bolt and the frame member at another portion of the bolt so as to laterally move the frame into contact with the rim;

an adjustment bolt receiving member attached to the frame member adjacent the upper end portion thereof, the adjustment bolt being threadably engaged therein; and a panel member adapted to be inserted onto the frame member to cover the open section.

* * * * *